US006250728B1

(12) United States Patent
Thorp

(10) Patent No.: US 6,250,728 B1
(45) Date of Patent: Jun. 26, 2001

(54) HANGING CLOSET APPARATUS

(76) Inventor: Bobby J. Thorp, 480 E. Blue Bonnet La., Hoffman Estates, IL (US) 60195

( * ) Notice: Subject to any disclaimer, the term of this patent is extended or adjusted under 35 U.S.C. 154(b) by 0 days.

(21) Appl. No.: 09/488,990

(22) Filed: Jan. 21, 2000

(51) Int. Cl.[7] ..... A47F 5/08

(52) U.S. Cl. ..... 312/247; 312/312; 312/242; 292/32

(58) Field of Search ..... 312/242, 245, 312/247, 215, 216, 218, 222, 312, 319.1, 319.4, 107.5, 306, 272; 292/32, 33, 36, 39

(56) References Cited

U.S. PATENT DOCUMENTS

| | | | | |
|---|---|---|---|---|
| D. 368,814 | | 4/1996 | Riback et al. . | |
| 2,382,354 | * | 8/1945 | Wales | 312/247 X |
| 2,499,791 | * | 3/1950 | Spencer | 312/247 X |
| 2,506,086 | * | 5/1950 | Jess | 312/247 X |
| 3,467,460 | * | 9/1969 | Acker | 312/242 X |
| 4,412,601 | | 11/1983 | Cooper . | |
| 4,669,773 | * | 6/1987 | LeVee | 296/37 |
| 5,203,619 | | 4/1993 | Welsch et al. . | |
| 5,475,949 | | 12/1995 | Mccoy . | |
| 5,535,852 | | 7/1996 | Bishop et al. . | |
| 5,667,035 | | 9/1997 | Hughes . | |
| 5,865,479 | * | 2/1999 | Viney | 292/39 |

* cited by examiner

*Primary Examiner*—Peter M. Cuomo
*Assistant Examiner*—Michael J. Fisher

(57) ABSTRACT

A hanging closet apparatus for storing items in the ceiling. The hanging closet apparatus includes a housing having a top wall, a bottom wall, a back wall, a first side wall, and a second side wall. A plurality of apertures is in the first and second side walls. A latch means selectively holds the housing in an extending position from the ceiling and a retracted position in the ceiling. The latch means extends through the apertures in the housing in a locked position. An enclosure receives the housing in the ceiling. The enclosure is mounted in the ceiling. The enclosure has two pairs of opposing walls. A first pair of opposing walls has apertures therein. The apertures in the enclosure are positioned such that the apertures in the housing are aligned with the apertures in the enclosure when the housing is in the enclosure. A biasing means biases the housing toward the retracted position in the enclosure. The biasing means comprises a pulley system.

12 Claims, 3 Drawing Sheets

10
51
60
53
62
64
54
61
67
50
56
66
52
68
70
55
57
58
13
12
25
16
72
15
17
22
19
20
14
24
18

3
31
46
30
3

37
30
42
36
31
43
35

FIG 4
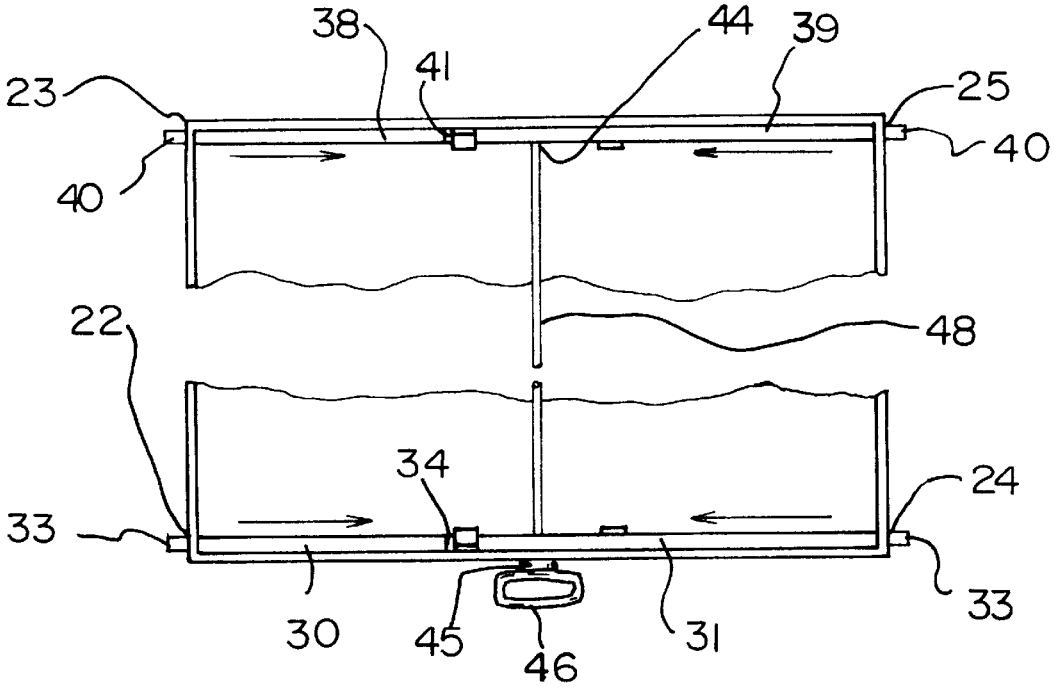
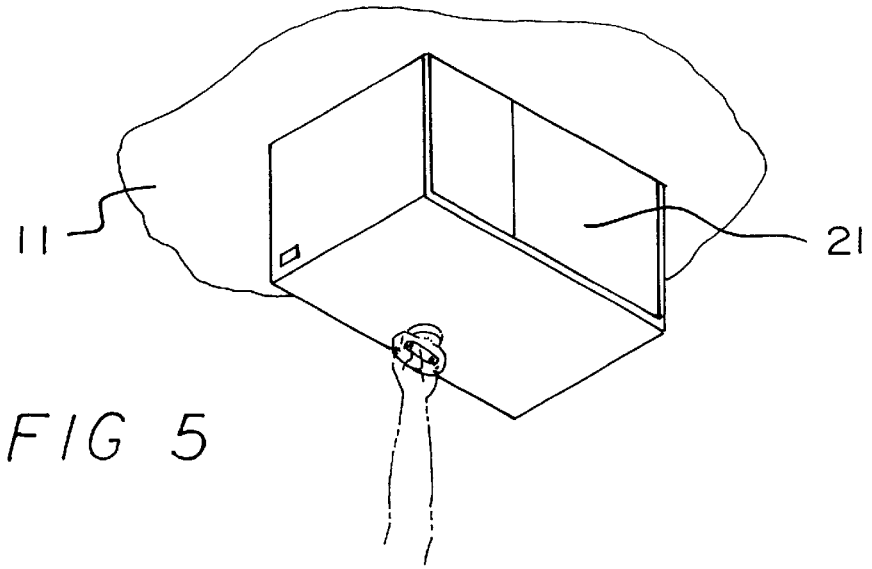
FIG 5

HANGING CLOSET APPARATUS

BACKGROUND OF THE INVENTION

1. Field of the Invention

The present invention relates to storage systems and more particularly pertains to a new hanging closet apparatus for storing items in the ceiling.

2. Description of the Prior Art

The use of storage systems is known in the prior art. More specifically, storage systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,667,035; U.S. Pat. No. 5,475,949; U.S. Pat. No. 5,203,619; U.S. Pat. No. 4,412,601; U.S. Pat. No. 5,535,852; and U.S. Des. Patent No. 362,814.

While these devices fulfill their respective, particular objectives and requirements, the aforementioned patents do not disclose a new hanging closet apparatus. The inventive device includes a housing having a top wall, a bottom wall, a back wall, a first side wall, and a second side wall. A plurality of apertures is in the first and second side walls. A latch means selectively holds the housing in an extending position from the ceiling and a retracted position in the ceiling. The latch means extends through the apertures in the housing in a locked position. An enclosure receives the housing in the ceiling. The enclosure is mounted in the ceiling. The enclosure has two pairs of opposing walls. A first pair of opposing walls has apertures therein. The apertures in the enclosure are positioned such that the apertures in the housing are aligned with the apertures in the enclosure when the housing is in the enclosure. A biasing means biases the housing toward the retracted position in the enclosure. The biasing means comprises a pulley system coupled to the enclosure and the housing.

In these respects, the hanging closet apparatus according to the present invention substantially departs from the conventional concepts and designs of the prior art, and in so doing provides an apparatus primarily developed for the purpose of storing items in the ceiling.

SUMMARY OF THE INVENTION

In view of the foregoing disadvantages inherent in the known types of storage systems now present in the prior art, the present invention provides a new hanging closet apparatus construction wherein the same can be utilized for storing items in the ceiling.

The general purpose of the present invention, which will be described subsequently in greater detail, is to provide a new hanging closet apparatus apparatus and method which has many of the advantages of the storage systems mentioned heretofore and many novel features that result in a new hanging closet apparatus which is not anticipated, rendered obvious, suggested, or even implied by any of the prior art storage systems, either alone or in any combination thereof.

To attain this, the present invention generally comprises a housing having a top wall, a bottom wall, a back wall, a first side wall, and a second side wall. A plurality of apertures is in the first and second side walls. A latch means selectively holds the housing in an extending position from the ceiling and a retracted position in the ceiling. The latch means extends through the apertures in the housing in a locked position. An enclosure receives the housing in the ceiling. The enclosure is mounted in the ceiling. The enclosure has two pairs of opposing walls. A first pair of opposing walls has apertures therein. The apertures in the enclosure are positioned such that the apertures in the housing are aligned with the apertures in the enclosure when the housing is in the enclosure. A biasing means biases the housing toward the retracted position in the enclosure. The biasing means comprises a pulley system.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hanging closet apparatus apparatus and method which has many of the advantages of the storage systems mentioned heretofore and many novel features that result in a new hanging closet apparatus which is not anticipated, rendered obvious, suggested, or even implied by any of the prior art storage systems, either alone or in any combination thereof.

It is another object of the present invention to provide a new hanging closet apparatus which may be easily and efficiently manufactured and marketed.

It is a further object of the present invention to provide a new hanging closet apparatus which is of a durable and reliable construction.

An even further object of the present invention is to provide a new hanging closet apparatus which is susceptible of a low cost of manufacture with regard to both materials and labor, and which accordingly is then susceptible of low prices of sale to the consuming public, thereby making such hanging closet apparatus economically available to the buying public.

Still yet another object of the present invention is to provide a new hanging closet apparatus which provides in the apparatuses and methods of the prior art some of the advantages thereof, while simultaneously overcoming some of the disadvantages normally associated therewith.

Still another object of the present invention is to provide a new hanging closet apparatus for storing items in the ceiling.

Yet another object of the present invention is to provide a new hanging closet apparatus which includes a housing having a top wall, a bottom wall, a back wall, a first side wall, and a second side wall. A plurality of apertures is in the first and second side walls. A latch means selectively holds the housing in an extending position from the ceiling and a retracted position in the ceiling. The latch means extends through the apertures in the housing in a locked position. An enclosure receives the housing in the ceiling. The enclosure is mounted in the ceiling. The enclosure has two pairs of opposing walls. A first pair of opposing walls has apertures therein. The apertures in the enclosure are positioned such that the apertures in the housing are aligned with the apertures in the enclosure when the housing is in the enclosure. A biasing means biases the housing toward the retracted position in the enclosure. The biasing means comprises a pulley system.

Still yet another object of the present invention is to provide a new hanging closet apparatus that has a biasing system for easy lifting of the housing into a retracted position.

Even still another object of the present invention is to provide a new hanging closet apparatus that has a latch means for preventing the housing from leaving the retracting position if the biasing means fails.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a schematic front view of the latch means of the present invention.

FIG. 5 is a schematic perspective view of the present invention.

DESCRIPTION OF THE PREFERRED EMBODIMENT

Figure 1:
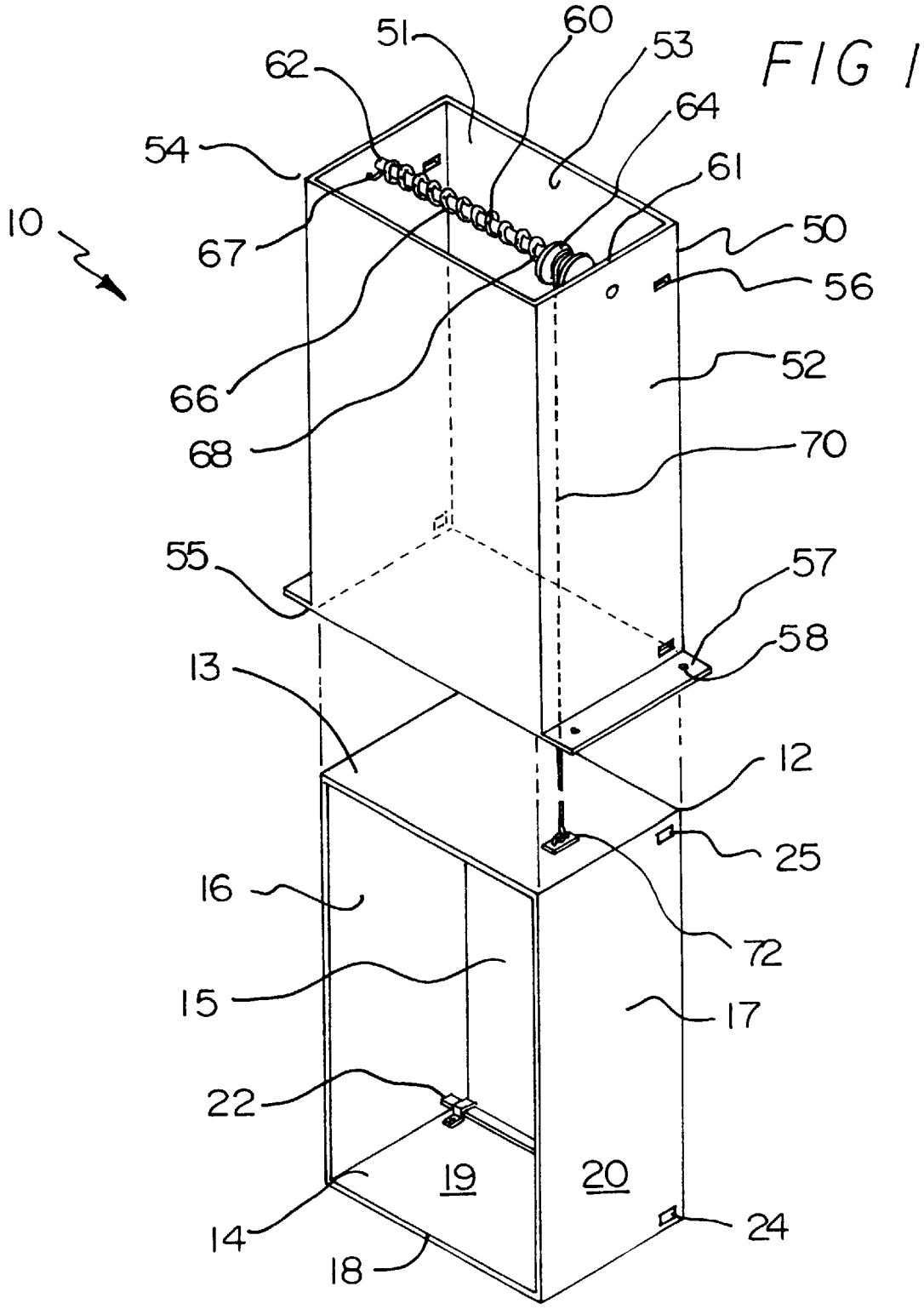
FIG. 1 is a schematic perspective view of a new hanging closet apparatus according to the present invention.
Figure 2:
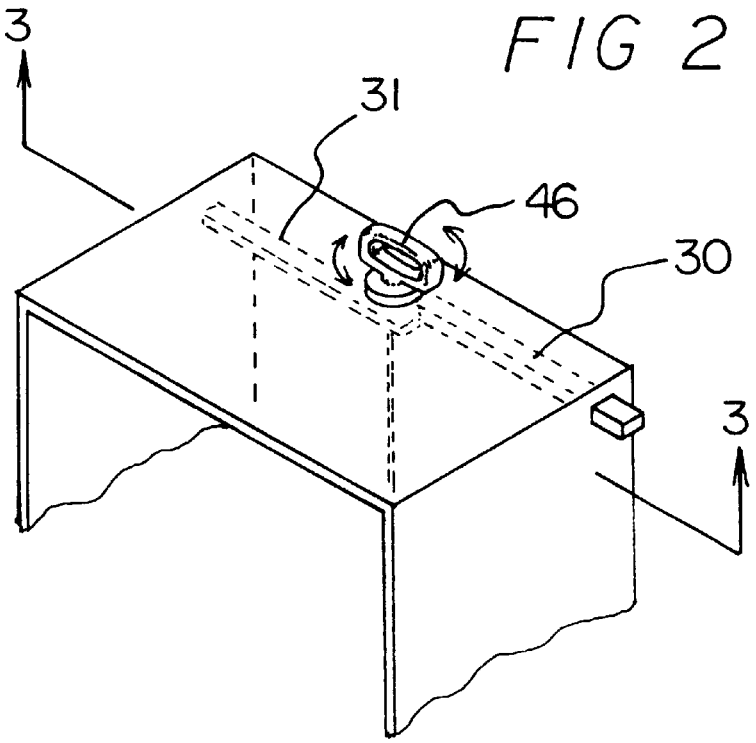
FIG. 2 is a schematic perspective view of the bottom wall of the housing of the present invention.
Figure 3:
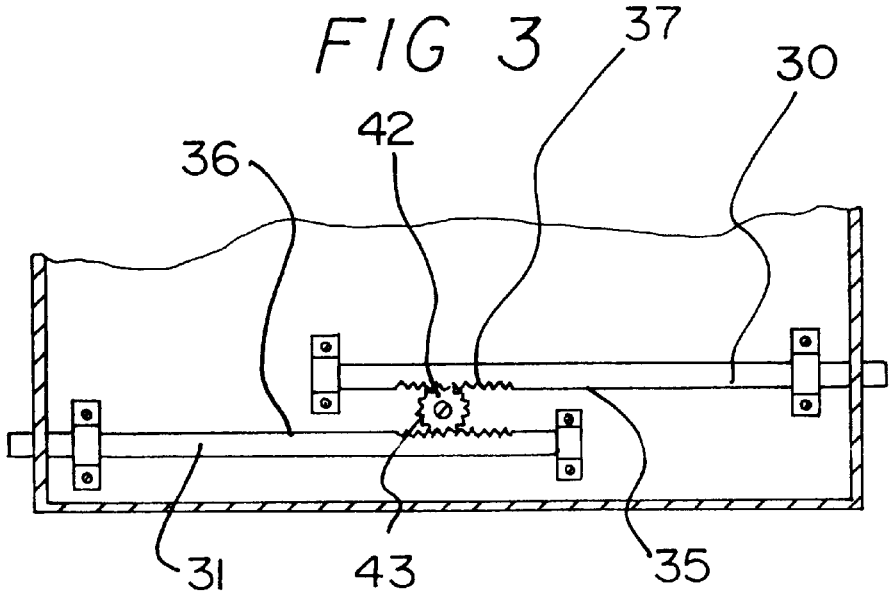
FIG. 3 is a schematic cross-sectional view taken along line 3—3 of the present invention.

With reference now to the drawings, and in particular to FIGS. 1 through 5 thereof, a new hanging closet apparatus embodying the principles and concepts of the present invention and generally designated by the reference numeral 10 will be described.

As best illustrated in FIGS. 1 through 5, the hanging closet apparatus 10 generally comprises a housing 12. The housing 12 has a top wall 13, a bottom wall 14, a back wall 15, a first side wall 16, a second side wall 17, and a front peripheral edge 18. The housing has an interior surface 19 and an exterior surface 20.

A pair of sliding panels 21 for closing an interior of the housing 12 is mounted in the interior surface 19 of the housing 12. Each of the panels 21 is generally adjacent to the front peripheral edge 18 of the housing 12.

A first aperture 22 in the housing 12 is in the first side wall 16. The first aperture 22 is positioned generally adjacent to the back wall 15 and the bottom wall 14.

A second aperture 23 in the housing is in the first side wall 16. The second aperture 23 is positioned generally adjacent to the back wall 15 and the top wall 13.

A third aperture 24 in the housing 12 is in the second side wall 17. The third aperture 24 is positioned generally adjacent to the back wall 15 and the bottom wall 14.

A fourth aperture 25 in the housing 12 is in the second side wall 17, and is positioned generally adjacent to the back wall 15 and the top wall 13.

A latch means selectively holds the housing 12 in an extended position from the ceiling 11 and a retracted position in the ceiling. The latch means comprises a plurality of bars and gears.

A first bar 30 and a second bar 31 are each elongate. The first 30 and second 31 bars have a first end 33 and a second end 34. Each of the first 30 and second 31 bars is slidably coupled to the interior surface 19 of the bottom wall 14. The first end 33 of the first bar 30 is aligned with the first aperture 22 such that a portion of the first bar 30 may extend through the first aperture 22. The first end 33 of the second bar 31 is aligned with the third aperture 24 such that a portion of the second bar 31 may extend through the third aperture 24. The first bar 30 has an edge 35 opposed to an edge 36 of the second bar 31. The edges 35, 36 of the first 30 and second 31 bars are spaced, and the edges of the first and second bars have teeth 37 therein. The first 30 and second 31 bars each have a generally rectangular shaped cross-section taken transverse to longitudinal axis of the first and second bars.

A third bar 38 and a fourth bar 39 are elongate having a first end 40 and a second end 41. Each of the third 38 and fourth 39 bars is slidably coupled to the interior surface 19 of the top wall 13. The first end 40 of the third bar 38 is aligned with the second aperture 23 such that a portion of the third bar may extend through the second aperture. The first end 40 of the fourth bar 39 is aligned with the fourth aperture 25 such that a portion of the fourth bar may extend through the fourth aperture. The third bar 39 has an edge opposed to an edge of the fourth bar in a manner substantially identical to the edges 35, 36 of the first 30 and second 31 bars. The edges of the third and fourth bars are spaced. The edges of the third and fourth bars have teeth therein. The third and fourth bars each have a generally rectangular shaped cross-section taken transverse to longitudinal axis of the third and fourth bars.

A first gear wheel 42 has a peripheral edge 43 having teeth therein. The first gear wheel 42 is rotatably mounted to the bottom wall 14. The first gear wheel 42 is positioned between the first 30 and second 31 bars. The teeth of the first gear wheel 42 are in communication with the teeth 37 in the first and second bars.

A second gear wheel, not shown, has a peripheral edge having teeth therein. The second gear wheel is rotatably mounted to the interior surface 19 of the top wall 13. The second gear wheel is positioned between the third 38 and fourth 39 bars. The teeth of the second gear wheel are in communication with the teeth in the third and fourth bars.

A rod 48 mechanically connects the first and second gear wheels. The rod 48 has a first end 44 and a second end 45. The first end 44 of the rod is coupled to central portion of the second gear wheel. The second end 45 of the rod 48 extends through a central portion of the first gear wheel 42 and through the bottom wall 19.

A handle 46 for turning the rod 48 is fixedly coupled to the second end 45 of the rod 48.

An enclosure 50 receives the housing 12 in the ceiling 11. The enclosure 50 is mounted in the ceiling 11, and has an interior surface 51. The enclosure 50 has two pairs of opposing walls 52, 53, a top edge 54 and bottom edge 55. A first pair of opposing walls 52 has apertures 56 therein. The apertures 56 in the enclosure are positioned such that the apertures 22–25 in the housing 12 are aligned with the apertures 56 in the enclosure 50 when the housing 12 is in the enclosure 50.

A fastening means for fastening the enclosure 50 to the ceiling 11 comprises a pair of flanges 57. Each of the flanges 57 is integrally coupled to one of the first opposing walls 52. The flanges 57 are located generally abutted against the bottom edge 55 of the enclosure 50. Each of the flanges 57 extends away from the enclosure 50 and each of the flanges 57 has a plurality of bores 58 therein.

A securing means, not shown, secures each of the flanges 57 to the ceiling 11. Each of the securing means extends through the bores 58 and the ceiling 11. Each of the securing means is a screw.

A biasing means biases the housing toward the retracted position in the enclosure. The biasing means comprises an elongate member 60 having a first end 61 and a second end 62, where the first 61 and second 62 ends are rotatably mounted in one of the first pair 52 of opposing walls.

A pulley member 64 is fixedly mounted on the elongate member 60. The pulley member 64 is generally adjacent to the first end 61 of the elongate member 60. The elongate member 60 extends through a central portion of the pulley member 64.

A spring 66 biases rotation of the elongate member 60 in a first direction. The spring 66 has a first end 67 and a second end 68. The spring 66 is wrapped about the elongate member 60. The first end 67 of the spring 66 is fixedly coupled to one of the first opposing walls 52 generally adjacent to the second end 62 of the elongate member 60. The second end 68 of the spring 66 is fixedly coupled to the pulley member 64.

A cord 70 has a first end, shown wrapped about the pulley, and a second end 72. The first end is fixedly coupled to the pulley member 64, and the second end 72 is fixedly coupled to the exterior surface 20 of the top wall 13.

In use, the user turns the handle 46, which releases the bars 30, 31, 38, 39 from the apertures 22–25, 56 and allows the user to pull the housing 12 down. The housing 12 may be fitted with racks of bars to set items on. The user then pushes the housing 12 back into the enclosure 50 and turns the handle 46, which locks the housing 12 in the retracted position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hanging closest apparatus, said apparatus being mountable in a ceiling, said apparatus comprising:

a housing, said housing having a top wall, a bottom wall, a back wall, a first side wall, a second side wall, and a front peripheral edge;

a plurality of apertures in said first and second side walls;

a latch means for selectively holding the housing in an extending position and a retracted position, said latch means extending through said apertures in said housing in a locked position;

an enclosure for receiving said housing, said enclosure having two pairs of opposing walls, a first pair of opposing walls having apertures therein, said apertures in said enclosure being positioned such that said apertures in said housing are aligned with said apertures in said enclosure when said housing is in said enclosure;

a biasing means for biasing said housing toward said retracted position in said enclosure, said biasing means comprising a pulley system coupled to said enclosure and said housing;

wherein said plurality of said apertures in said housing comprise:

a first aperture in said housing, said first aperture being in said first side wall, said first aperture being positioned generally adjacent to said back wall and said bottom wall; and a second aperture in said housing, said second aperture being in said first side wall, said second aperture being positioned generally adjacent to said back wall and said top wall;

a third aperture in said housing, said third aperture being in said second side wall, said third aperture being positioned generally adjacent to said back wall and said bottom wall; and a fourth aperture in said housing, said fourth aperture being in said second side wall, said fourth aperture being positioned generally adjacent to said back wall and said top wall.

2. The hanging closest apparatus as in claim 1, further comprising:

a pair of sliding panels for closing an interior of said housing, each of said sliding panels being mounted in an interior surface of said housing, each of said panels being generally adjacent to said front peripheral edge of said housing.

3. The hanging closest apparatus as in claim 1, wherein said latch means further comprises:

a first bar and a second bar, each of said first and second bars being elongate, each of said first and second bars having a first end and a second end, each of said first and second bars being slidably coupled to said interior surface of said bottom wall, said first end of said first bar being aligned with said first aperture such that a portion of said first bar may extend through said first aperture, said first end of said second bar being aligned with said third aperture such that a portion of said second bar may extend through said third aperture, said first bar having an edge being opposed to an edge of said second bar, said edges of said first and second bars being spaced, said edges of said first and second bars having teeth therein;

a first gear wheel, said first gear wheel having a peripheral edge having teeth therein, said first gear wheel being rotatably mounted to said bottom wall, said first gear wheel being positioned between said first and second bars, said teeth of said first gear wheel being in communication with said teeth in said first and second bars;

a rod, said rod extending through said first gear and through said bottom wall; and a handle for turning said rod, said handle being fixedly coupled to said rod such that said bottom wall is between said handle and said first gear.

4. The hanging closest apparatus as in claim 3, further comprising:

a third bar and a fourth bar, each of said third and fourth bars being elongate, each of said third and fourth bars having a first end and a second end, each of said third and fourth bars being slidably coupled to said interior surface of said top wall, said first end of said third bar being aligned with said second aperture such that a portion of said third bar may extend through said second aperture, said first end of said fourth bar being aligned with said fourth aperture such that a portion of said fourth bar may extend through said fourth aperture, said third bar having an edge being opposed to an edge of said fourth bar, said edges of said third and fourth bars being spaced, said edges of said third and fourth bars having teeth therein;

a second gear wheel, said second gear wheel having a peripheral edge having teeth therein, said second gear wheel being rotatably mounted to said top wall, said second gear wheel being positioned between said third and fourth bars, said teeth of said second gear wheel being in communication with said teeth in said third and fourth bars; and said rod extending upwardly from said first gear and being fixedly coupled to said second gear.

5. The hanging closest apparatus as in claim 1, further comprising:

said enclosure having a top edge and bottom edge;

a fastening means for fastening said enclosure to the ceiling, said fastening means comprising:

a pair of flanges, each of said flanges being integrally coupled to one of said first opposing walls, each of said flanges being located generally abutted against said bottom edge of said enclosure, each of said flanges extending away from said enclosure, each of said flanges having a plurality of bores therein; and a securing means for securing each of said flanges to the ceiling, each of said securing means extending through said bores.

6. The hanging closest apparatus as in claim 1, wherein said biasing means comprises:

an elongate member, said elongate member having a first end and a second end, said first and second ends being rotatably mounted in one of said first pair of opposing walls;

a pulley member, said pulley member being fixedly mounted on said elongate member;

a spring for biasing a rotation of said elongate member in a first direction, said spring having a first end and a second end, said spring being wrapped about said elongate member, said first end of said spring being fixedly coupled to one of said first opposing wall generally adjacent to said second end of said elongate member, said second end of said spring being fixedly coupled to said pulley; and a cord, said cord having a first end and a second end, said first end being fixedly coupled to said pulley member, said second end being fixedly coupled to said exterior surface of said top wall.

7. A hanging closest system for mounting in a ceiling wall, said system comprising:

a housing, said housing having a top wall, a bottom wall, a back wall, a first side wall, a second side wall, and a front peripheral edge, said housing having an interior surface and an exterior surface;

a pair of sliding panels for closing an interior of said housing, each of said sliding panels being mounted in said interior surface of said housing, each of said panels being generally adjacent to said front peripheral edge of said housing;

a first aperture in said housing, said first aperture being in said first side wall, said first aperture being positioned generally adjacent to said back wall and said bottom wall;

a second aperture in said housing, said second aperture being in said first side wall, said second aperture being positioned generally adjacent to said back wall and said top wall;

a third aperture in said housing, said third aperture being in said second side wall, said third aperture being positioned generally adjacent to said back wall and said bottom wall;

a fourth aperture in said housing, said fourth aperture being in said second side wall, said fourth aperture being positioned generally adjacent to said back wall and said top wall;

a latch means for selectively holding the housing in an extending position and a retracted position, said latch means comprising:

a first bar and a second bar, each of said first and second bars being elongate, each of said first and second bars having a first end and a second end, each of said first and second bars being slidably coupled to said interior surface of said bottom wall, said first end of said first bar being aligned with said first aperture such that a portion of said first bar may extend through said first aperture, said first end of said second bar being aligned with said third aperture such that a portion of said second bar may extend through said third aperture, said first bar having an edge being opposed to an edge of said second bar, said edges of said first and second bars being spaced, said edges of said first and second bars having teeth therein, said first and second bars each having a generally rectangular shaped cross-section taken transverse to longitudinal axis of said first and second bars;

a third bar and a fourth bar, each of said third and fourth bars being elongate, each of said third and fourth bars having a first end and a second end, each of said third and fourth bars being slidably coupled to said interior surface of said top wall, said first end of said third bar being aligned with said second aperture such that a portion of said third bar may extend through said second aperture, said first end of said fourth bar being aligned with said fourth aperture such that a portion of said fourth bar may extend through said fourth aperture, said third bar having an edge being opposed to an edge of said fourth bar, said edges of said third and fourth bars being spaced, said edges of said third and fourth bars having teeth therein, said third and fourth bars each having a generally rectangular shaped cross-section taken transverse to longitudinal axis of said third and fourth bars;

a first gear wheel, said first gear wheel having a peripheral edge having teeth therein, said first gear wheel being rotatably mounted to said bottom wall, said first gear wheel being positioned between said first and second bars, said teeth of said first gear wheel being in communication with said teeth in said first and second bars;

a second gear wheel, said second gear wheel having a peripheral edge having teeth therein, said second gear wheel being rotatably mounted to said top wall, said second gear wheel being positioned between said third and fourth bars, said teeth of said second gear wheel being in communication with said teeth in said third and fourth bars;

a rod for mechanically connecting said first and second gear wheels, said rod having a first end and a second end, said first end of said rod being coupled to central portion of said second gear wheel, said second end of said rod extending through a central portion of said first gear wheel and through said bottom wall;

a handle for turning said rod, said handle being fixedly coupled to said second end of said rod;

an enclosure for receiving said housing, said enclosure having an interior surface, said enclosure having two pairs of opposing walls, a top edge and bottom edge, a first pair of opposing walls having apertures therein, said apertures in said enclosure being positioned such that said apertures in said housing are aligned with said apertures in said enclosure when said housing is in said enclosure;

a fastening means for fastening said enclosure to the ceiling, said fastening means comprising:

a pair of flanges, each of said flanges being integrally coupled to one of said first opposing walls, each of said flanges being located generally abutted against said bottom edge of said enclosure, each of said flanges extending away from said enclosure, each of said flanges having a plurality of bores therein;

a securing means for securing each of said flanges to the ceiling, each of said securing means extending through said bores and said ceiling, each of said securing means being a screw;

a biasing means for biasing said housing toward said retracted position in said enclosure, said biasing means comprising:

an elongate member, said elongate member having a first end and a second end, said first and second ends being rotatably mounted in one of said first pair of opposing walls;

a pulley member, said pulley member being fixedly mounted on said elongate member, said pulley member being generally adjacent to said first end of said elongate member, said elongate member extending through a central portion of said pulley member;

a spring for biasing a rotation of said elongate member in a first direction, said spring having a first end and a second end, said spring being wrapped about said elongate member, said first end of said spring being fixedly coupled to one of said first opposing wall generally adjacent to said second end of said elongate member, said second end of said spring being fixedly coupled to said pulley; and a cord, said cord having a first end and a second end, said first end being fixedly coupled to said pulley member, said second end being fixedly coupled to said exterior surface of said top wall.

8. A hanging closest apparatus for mounting in a ceiling, said apparatus comprising:

a housing having a top wall, a bottom wall, a back wall, a first side wall, a second side wall, and a front peripheral edge;

a plurality of apertures in said first and second side walls;

an enclosure for receiving said housing, said enclosure having two pairs of opposing walls, a first pair of opposing walls having apertures therein, said apertures in said enclosure being positioned such that said apertures in said housing are alignable with said apertures in said enclosure when said housing is in said enclosure;

a latch means for selectively holding the housing in a retracted position in a retracted position in said enclosure and an extended position out of said enclosure, said latch means being extendable through said apertures in said housing in a locked position of said latch means;

wherein one of said plurality of said apertures in said housing is located in said first side wall generally adjacent to said top wall; and wherein one of said plurality of apertures in said housing is located in said second side wall generally adjacent to said top wall.

9. The hanging closet apparatus as in claim 8 further comprising a biasing means for biasing said housing toward said retracted position in said enclosure.

10. The hanging closet apparatus as in claim 9 wherein said biasing means comprises a pulley system coupled to said enclosure and said housing.

11. The hanging closest apparatus as in claim 8 further comprising a pair of sliding panels for closing an interior of said housing.

12. The hanging closest apparatus as in claim 8 wherein said enclosure has a top edge and bottom edge; and additionally comprising:

a fastening means for fastening said enclosure to the ceiling, said fastening means comprising:

a pair of flanges, each of said flanges being integrally coupled to one of said first opposing walls, each of said flanges being located generally abutted against said bottom edge of said enclosure, each of said flanges extending away from said enclosure, each of said flanges having a plurality of bores therein; and a securing means for securing each of said flanges to the ceiling, each of said securing means extending through said bores.

* * * * *